US011568826B2

(12) United States Patent
Choi et al.

(10) Patent No.: US 11,568,826 B2
(45) Date of Patent: Jan. 31, 2023

(54) ELECTROLUMINESCENCE DISPLAY APPARATUS AND DRIVING METHOD THEREOF

(71) Applicant: LG Display Co., Ltd., Seoul (KR)

(72) Inventors: Ji Su Choi, Gimpo-si (KR); Myung Gi Lim, Seoul (KR); Kyung Hyun Lim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/825,969

(22) Filed: May 26, 2022

(65) Prior Publication Data

US 2022/0383826 A1 Dec. 1, 2022

(30) Foreign Application Priority Data

May 28, 2021 (KR) ..... 10-2021-0069418

(51) Int. Cl.
*G09G 3/3291* (2016.01)

(52) U.S. Cl.
CPC ... *G09G 3/3291* (2013.01); *G09G 2300/0842* (2013.01); *G09G 2310/027* (2013.01); *G09G 2310/0291* (2013.01)

(58) Field of Classification Search
CPC .. G09G 3/3233; G09G 3/3275; G09G 3/3225; G09G 3/3258; G09G 2300/0819; G09G 2300/0861; G09G 2300/043; G09G 2320/043; G09G 2320/0233; G09G 2320/045; G09G 2320/0295; G09G 2320/029; G09G 2320/0693; G09G 2320/0252; G09G 2320/0626; G09G 2310/08
See application file for complete search history.

(56) References Cited

U.S. PATENT DOCUMENTS

2017/0193923 A1* 7/2017 Park ..... G09G 3/3233
2021/0104195 A1* 4/2021 Choi ..... G09G 3/3233

* cited by examiner

*Primary Examiner* — Dong Hui Liang
(74) *Attorney, Agent, or Firm* — Morgan, Lewis & Bockius LLP

(57) ABSTRACT

An electroluminescence display apparatus includes a pixel including a driving element generating a driving current, a data line connected to the pixel to transfer a data voltage needed for generating the driving current, a reference voltage line connected to the pixel to transfer a first reference voltage and/or a second reference voltage needed for generating the driving current, and a driving & sensing circuit configured to perform an integral on the driving current input through the reference voltage line, output an integral result to the data line, decrease a voltage of the data line from the data voltage to an off voltage for turning off the driving element, and detect an off voltage of the driving element from the data line.

11 Claims, 18 Drawing Sheets

ELECTROLUMINESCENCE DISPLAY APPARATUS AND DRIVING METHOD THEREOF

CROSS-REFERENCE TO RELATED APPLICATIONS

This application claims the benefit of the Korean Patent Application No. 10-2021-0069418 filed on May 28, 2021, which is hereby incorporated by reference as if fully set forth herein.

BACKGROUND

Technical Field

The present disclosure relates to an electroluminescence display apparatus and a driving method thereof.

Discussion of the Related Art

In electroluminescence display apparatuses having an active matrix type, a plurality of pixels each including a light emitting device and a driving element are arranged as a matrix type, and the luminance of an image implemented by the pixels is adjusted based on a gray level of image data. The driving element controls a pixel current flowing in the light emitting device on the basis of a voltage (hereinafter referred to as a gate-source voltage) applied between a gate electrode and a source electrode thereof. The amount of light emitted by the light emitting device and the luminance of a screen are determined based on a pixel current.

Because a threshold voltage of a driving element determines a driving characteristic of a pixel, the threshold voltage should be constant in all pixels, but a driving characteristic between pixels may be changed by various causes such as a process characteristic and a degradation characteristic. Such a driving characteristic difference causes a luminance deviation, and due to this, there is a limitation in implementing a desired image.

Compensation technology for compensating for a luminance deviation between pixels has been proposed, but is not high in compensation performance due to noise occurring in a sensing process.

SUMMARY

Accordingly, embodiments of the present disclosure are directed to an electroluminescence display apparatus and a driving method thereof that substantially obviate one or more of the problems due to limitations and disadvantages of the related art.

An aspect of the present disclosure is to provide an electroluminescence display apparatus for increasing sensing performance and compensation performance and a driving method thereof.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, an electroluminescence display apparatus comprises: a pixel including a driving element generating a driving current; a data line connected to the pixel to transfer a data voltage needed for generating the driving current; a reference voltage line connected to the pixel to transfer a first reference voltage and/or a second reference voltage needed for generating the driving current; and a driving & sensing circuit configured to perform an integral on the driving current input through the reference voltage line, output an integral result to the data line, decrease a voltage of the data line from the data voltage to an off voltage for turning off the driving element, and detect an off voltage of the driving element from the data line.

In another aspect, a driving method of an electroluminescence display apparatus comprises a pixel including a driving element generating a driving current, includes: supplying a data voltage, needed for generating the driving current, to a data line connected to the pixel; supplying a first reference voltage and/or a second reference voltage, needed for generating the driving current, to a reference voltage line connected to the pixel; performing an integral on the driving current input through the reference voltage line, outputting an integral result to the data line, decreasing a voltage of the data line from the data voltage to an off voltage for turning off the driving element; and detecting an off voltage of the driving element from the data line.

It is to be understood that both the foregoing general description and the following detailed description are exemplary and explanatory and are intended to provide further explanation of the inventive concepts as claimed

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain principles of the disclosure. In the drawings.

DETAILED DESCRIPTION

Figure 1:
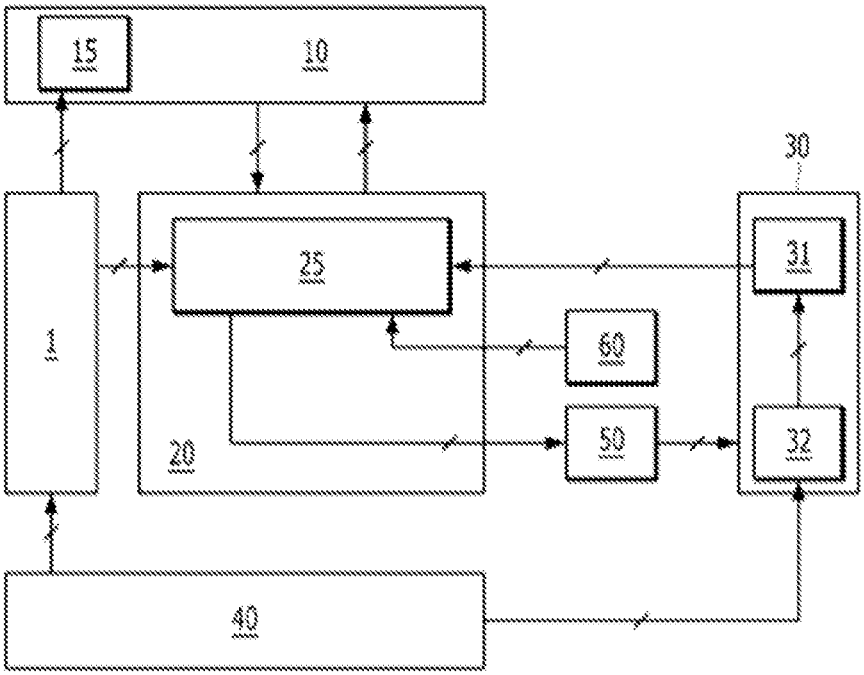
FIG. 1 is a diagram illustrating an electroluminescence display apparatus according to an embodiment of the present disclosure.

Hereinafter, the present disclosure will be described more fully with reference to the accompanying drawings, in which exemplary embodiments of the disclosure are shown. The disclosure may, however, be embodied in many different forms and should not be construed as being limited to the embodiments set forth herein; rather, these embodiments are provided so that this disclosure will be thorough and complete, and will fully convey the concept of the disclosure to those skilled in the art.

Advantages and features of the present disclosure, and implementation methods thereof will be clarified through following embodiments described with reference to the accompanying drawings. Furthermore, the present disclosure is only defined by scopes of claims.

The shapes, sizes, ratios, angles, numbers and the like disclosed in the drawings for description of various embodiments of the present disclosure to describe embodiments of the present disclosure are merely exemplary and the present disclosure is not limited thereto. Like reference numerals refer to like elements throughout. Throughout this specification, the same elements are denoted by the same reference numerals. As used herein, the terms "comprise", "having," "including" and the like suggest that other parts can be added unless the term "only" is used. As used herein, the singular forms "a", "an", and "the" are intended to include the plural forms as well, unless context clearly indicates otherwise.

Elements in various embodiments of the present disclosure are to be interpreted as including margins of error even without explicit statements.

In describing a position relationship, for example, when a position relation between two parts is described as "on~", "over~", "under~", and "next~", one or more other parts may be disposed between the two parts unless "just" or "direct" is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

Like reference numerals refer to like elements throughout.

In the specification, a pixel circuit provided on a substrate of a display panel may be implemented with a thin film transistor (TFT) having an n-type metal oxide semiconductor field effect transistor (MOSFET) structure, but is not limited thereto and may be implemented with a TFT having a p-type MOSFET structure. A TFT may be a three-electrode element which includes a gate, a source, and a drain. The source may be an electrode which supplies a carrier to a transistor. In the TFT, a carrier may start to flow from the source. The drain may be an electrode which enables the carrier to flow out from the TFT. That is, in a MOSFET, the carrier flows from the source to the drain. In the n-type TFT (NMOS), because a carrier is an electron, a source voltage may have a lower voltage than a drain voltage so that the electron flows from the source to the drain. In the n-type TFT, because the electron flows from the source to the drain, a current may flow from the drain to the source. On the other hand, in the p-type TFT (PMOS), because a carrier is a hole, a source voltage may be higher than a drain voltage so that the hole flows from the source to the drain. In the p-type TFT, because the hole flows from the source to the drain, a current may flow from the source to the drain. It should be noted that a source and a drain of a MOSFET are not fixed but switch therebetween. For example, the source and the drain of the MOSFET may switch therebetween.

Moreover, in the present disclosure, a semiconductor layer of a TFT may be implemented with at least one of an oxide element, an amorphous silicon element, and a polysilicon element.

In the following description, when the detailed description of the relevant known function or configuration is determined to unnecessarily obscure the important point of the present disclosure, the detailed description will be omitted. Hereinafter, embodiments of the present disclosure will be described in detail with reference to the accompanying drawings.

Figure 2:
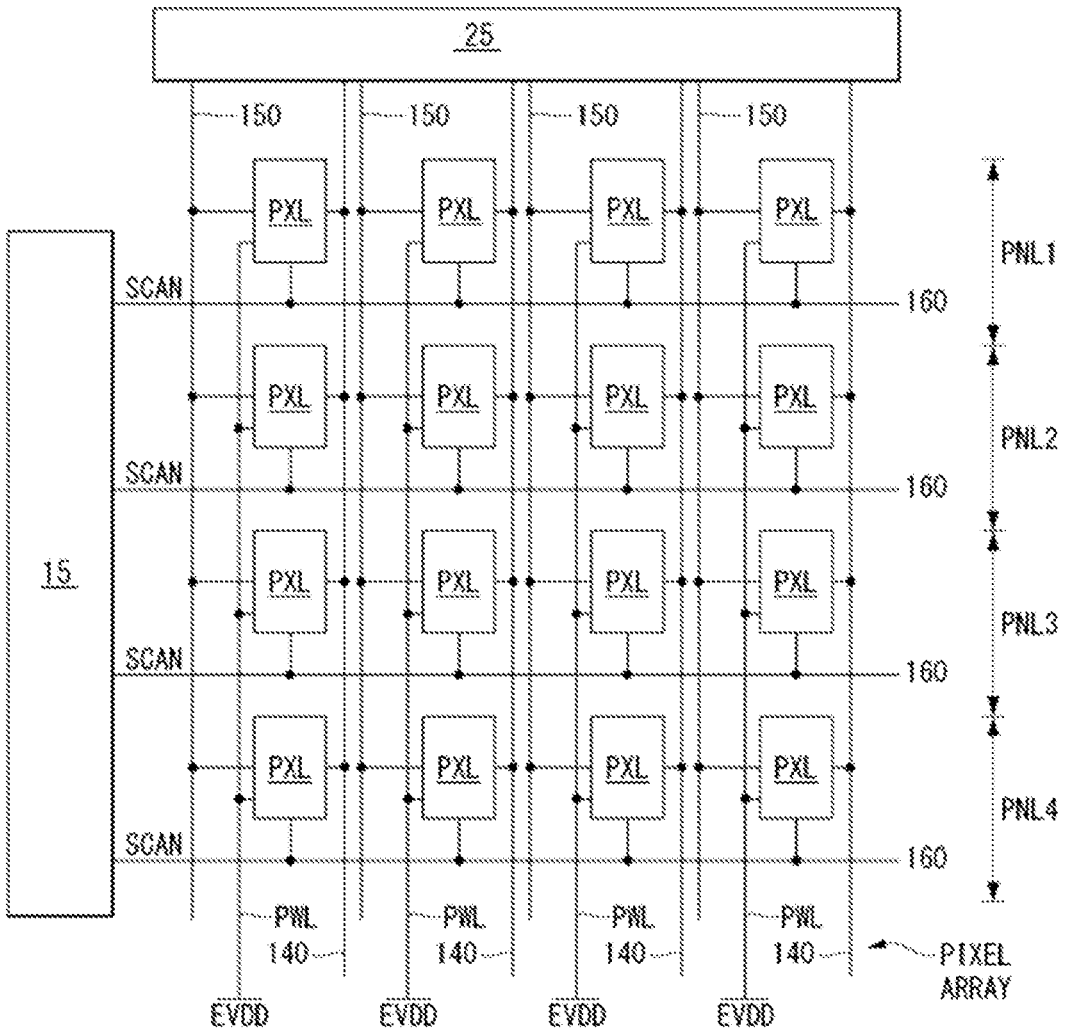
FIG. 2 is a diagram illustrating an example of a pixel array included in the display panel of FIG. 1.

FIG. 1 is a diagram illustrating an electroluminescence display apparatus according to an embodiment of the present disclosure. FIG. 2 is a diagram illustrating an example of a pixel array included in the display panel of FIG. 1.

Referring to FIGS. 1 and 2, the electroluminescence display apparatus according to an embodiment of the present disclosure may include a timing controller 1, a display panel 10, a driver integrated circuit (IC) 20, a compensation IC 30, a host system 40, a storage memory 50, and a power circuit 60. A gate driving circuit 15 included in the display panel 10 and a data driving circuit 25 embedded into the driver IC 20 may drive pixels PXL included in the display panel 10.

The display panel 10 may include a plurality of pixel lines PNL1 to PNL4, and each of the pixel lines PNL1 to PNL4 may include a plurality of pixels PXL and a plurality of signal lines. A "pixel line" described herein may not be a physical signal line and may denote a set of signal lines and pixels PXL adjacent to one another in an extension direction of a gate line. The signal lines may include a plurality of data lines 140 for supplying a display data voltage and a sensing data voltage to the pixels PXL, a plurality of reference voltage lines 150 for supplying a reference voltage to the pixels PXL, a plurality of gate lines 160 for supplying a gate signal SCAN to the pixels PXL, and a plurality of first power lines PWL for supplying a first source voltage EVDD to the pixels PXL.

The pixel PXL of the display panel 10 may be arranged as a matrix type to configure a pixel array. Each pixel PXL included in the pixel array of FIG. 2 may be connected to one of the data lines 140, one of the reference voltage lines 150, one of the first power lines PWL, and one of the gate lines 160. Each pixel PXL included in the pixel array of FIG. 2 may be connected to the plurality of gate lines 160. Also, each pixel PXL included in the pixel array of FIG. 2 may be further supplied with a second source voltage from the power circuit 60. The power circuit 60 may supply the second source voltage to the pixel PXL through a low level power line or a pad part.

The timing controller 1 may generate a gate timing control signal for controlling an operation timing of the gate driving circuit 15 and a data timing control signal for controlling an operation timing of the data driving circuit 25 with reference to timing signals (for example, a vertical synchronization signal Vsync, a horizontal synchronization signal Hsync, a dot clock signal DCLK, and a data enable signal DE) input from a host system 40.

The data timing control signal may include a source start pulse, a source sampling clock, and a source output enable signal, but is not limited thereto. The source start pulse may control a data sampling start timing of the driving voltage generating circuit. The gate timing control signal may include a gate start pulse and a gate shift clock, but is not limited thereto. The gate start pulse may be applied to a gate stage which generates a first gate output and may activate an operation of the gate stage. The gate shift clock may be input to the gate stages in common and may be a clock signal for shifting the gate start pulse.

The timing controller 1 may control a sensing driving timing and a display driving timing of the pixel lines PNL1 to PNL4 of the display panel 10 on the basis of a predetermined sequence, and thus, may implement a display driving operation and a sensing driving operation. The display driving operation and the sensing driving operation may be differently performed by operations of the gate driving circuit 15 and the data driving circuit 25 performed based on control by the timing controller 1.

Sensing driving may denote an operation which applies the sensing data voltage to pixels PXL included a sensing target pixel line to sense a threshold voltage variation of each of corresponding pixels PXL and updates a compensation value for compensating for a threshold voltage variation of each of the corresponding pixels PXL on the basis of sensing result data. Also, display driving may denote an operation which corrects digital image data, which is to be input to corresponding pixels PXL, on the basis of an updated compensation value and applies the display data voltage corresponding to corrected image data to the corresponding pixels PXL to display an input image on a screen (hereinafter referred to as screen reproduction).

The display driving operation may be performed in a vertical active period where the data enable signal is shifted between a logic high level and a logic low level in one frame, and the sensing driving operation may be performed in a vertical blank period except the vertical active period in one frame. In the vertical blank period, the data enable signal may continuously maintain a logic low level. The sensing driving operation may be performed in a power-on period until before screen reproduction starts after a system main power is applied thereto, or may be performed in a power-off period until before the system main power is released after the screen reproduction ends.

The gate driving circuit 15 may be embedded into the display panel 10. The gate driving circuit 15 may be disposed in a non-display area outside a display area where the pixel array is provided. The gate driving circuit 15 may include a plurality of gate stages connected to the gate lines 160 of the pixel array. The gate stages may generate the gate signal SCAN for controlling switch elements of the pixels PXL and may supply the gate signal SCAN to the gate lines 160.

The data driving circuit 25 embedded into the driver IC 20 may include a plurality of driving & sensing circuits. Each of the driving & sensing circuits may generate a sensing data voltage needed for sensing driving and a display data voltage needed for display driving. Each of the driving & sensing circuits may be connected to a data line 140 and a reference voltage line 150, may supply the display data voltage or the sensing data voltage to the data line 140, and may supply the reference voltage line 150 with a reference voltage input through the power circuit 60. The display data voltage may be a digital-to-analog conversion result of correction image data input from the compensation IC 30, and a level of the display data voltage may vary by pixel circuits on the basis of a grayscale value and a compensation value. The sensing data voltage may be differently generated in red (R), green (G), blue (B), and white (W) pixels on the basis of that a driving characteristic of a driving element is changed based on a color implemented by a light emitting device of each pixel PXL.

In display driving, a driving current may flow in the driving element of the pixel PXL on the basis of the display data voltage and the reference voltage, and the light emitting device of the pixel PXL may emit light with the driving current, whereby an image may be reproduced on a screen.

In sensing driving, when the driving current flows in the driving element of the pixel PXL on the basis of the sensing data voltage and the reference voltage, each of the driving & sensing circuits may perform an integral on the driving current and may output an integral result to the data line 140, and thus, a voltage of the data line 140 may be lowered to an off voltage which is lower than the sensing data voltage. The driving element may be turned off by an off voltage of the data line 140, and then, each of the driving & sensing circuits may detect the off voltage of the data line 140. The off voltage may be a criterion for determining a threshold voltage of the driving element. In sensing driving, the driving current flowing in the driving element may not contribute to the emission of light by the light emitting device and may be applied to only the driving & sensing circuit through the reference voltage line 150. Accordingly, in sensing driving, the light emitting device may not emit light.

Each of the driving & sensing circuits of the data driving circuit 25 may convert a detected threshold voltage of the driving element into digital sensing result data and may supply the digital sensing result data to the storage memory 50. The storage memory 50 may be implemented as flash memory, but is not limited thereto.

The compensation IC 30 may include a compensation circuit 31 and a compensation memory 32. The compensation memory 32 may transfer the digital sensing result data, read from the storage memory 50, to the compensation circuit 31. The compensation memory 32 may be random access memory (RAM) (for example, double data rate synchronous dynamic RAM (DDR SDRAM), but is not limited thereto. The compensation circuit 31 may calculate a compensation offset and a compensation gain for each pixel on the basis of the digital sensing result data, correct digital image data input from the host system 40 on the basis of the calculated compensation offset and compensation gain, and supply the corrected image data to the driver IC 20.

The power circuit 60 may generate the reference voltage needed for generating the driving current and may supply the reference voltage to the data driving circuit 25. The reference voltage may include a first reference voltage and/or a second reference voltage having different levels.

Figure 3:
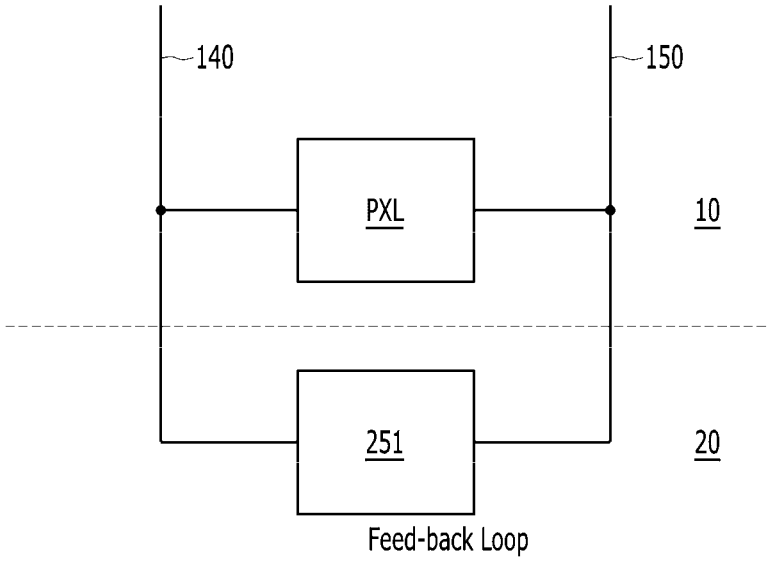
FIG. 3 is a diagram illustrating a method for increasing sensing performance on the basis of a driving & sensing circuit in an electroluminescence display apparatus according to an embodiment of the present disclosure.

FIG. 3 is a diagram illustrating a method for increasing sensing performance on the basis of a driving & sensing circuit in an electroluminescence display apparatus according to an embodiment of the present disclosure.

Referring to FIG. 3, when a driving current flows in a driving element of a pixel PXL on the basis of a sensing data voltage and a reference voltage in sensing driving, a driving & sensing circuit 251 may configure a feedback loop between a data line 140 and a reference voltage line 150, and thus, a gate-source voltage of the driving element may be lowered to a threshold voltage of the driving element for a short time. To this end, the driving & sensing circuit 251 may perform an integral on the driving current and may output an integral result to the data line 140, and thus, a voltage of the data line 140 may be lowered to an off voltage which is lower than the sensing data voltage and the off voltage may be detected. When a gate voltage of the driving element is shifted from the sensing data voltage to the off voltage on the basis of the driving current, a source voltage of the driving element may maintain the reference voltage.

Furthermore, in order to detect the threshold voltage of the driving element, a method has been known where a gate voltage of the driving element is fixed to a sensing data voltage and a source voltage of the driving element increases by using a source follower based on a driving current. Such technology detects a voltage of the reference voltage line when the driving element is turned off. However, in such technology, due to a parasitic capacitance of the reference voltage line connected to a source electrode of the driving element, because a time (hereinafter referred to as a sensing tack time) taken until the driving element is turned off (i.e., a time taken in detecting the threshold voltage of the driving element) is long, real-time sensing based on a vertical blank period is impossible.

On the other hand, in the following embodiments, by using a feedback loop configuration using a current integrator, the threshold voltage of the driving element may be quickly detected in a state where an influence of a parasitic capacitance of the reference voltage line is excluded. In the following embodiments, the current integrator may charge a feedback capacitor having a capacitance which is far less than the parasitic capacitance of the reference voltage line, and thus, a sensing tack time may be largely reduced. When the sensing tack time is reduced, real-time sensing and compensation may be performed and an update period of a compensation value may be short, and thus, the threshold voltage compensation performance of the driving element may be considerably enhanced.

First Embodiment

Figure 4:
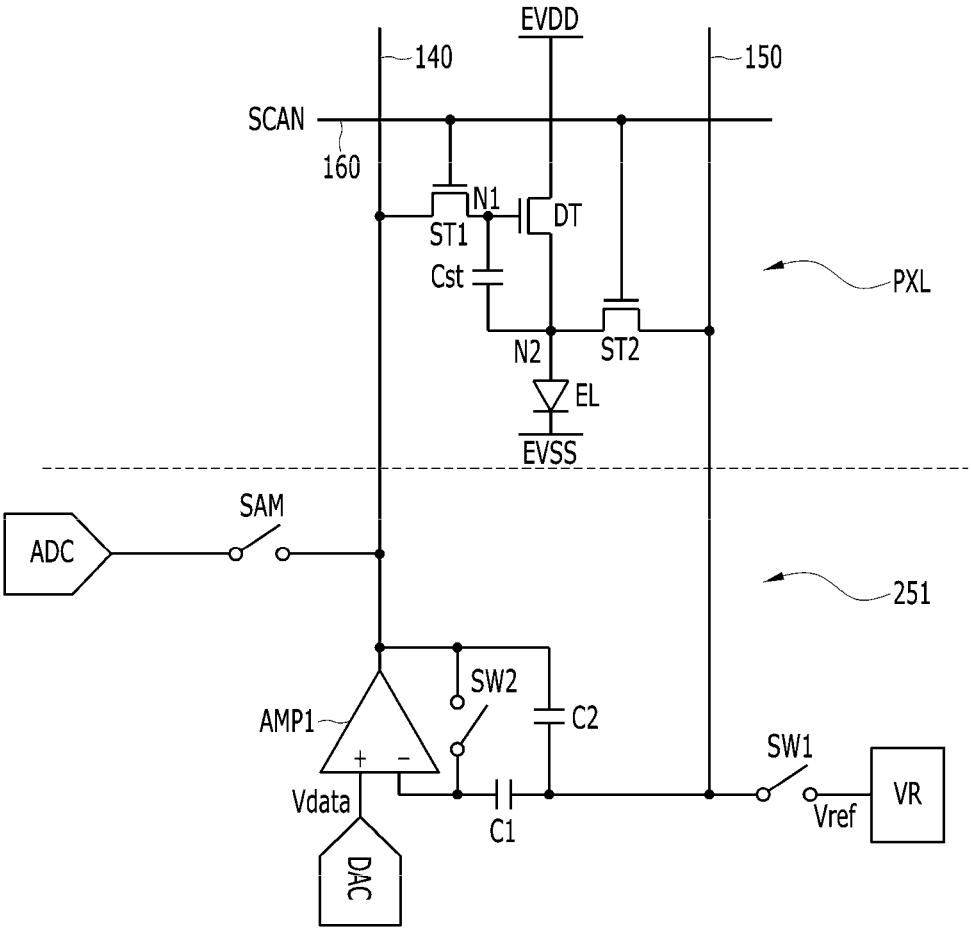
FIG. 4 is a diagram illustrating a first embodiment of a connection configuration between a pixel and the driving & sensing circuit included in FIG. 3.

FIG. 4 is a diagram illustrating a first embodiment of a connection configuration between a pixel and the driving & sensing circuit included in FIG. 3.

Referring to FIG. 4, a pixel PXL may include a light emitting element EL, a driving element DT, switch elements ST1 and ST2, and a storage capacitor Cst. The driving element DT and the switch elements ST1 and ST2 may each be implemented with an NMOS transistor, but are not limited thereto.

The light emitting device EL may emit light with a driving current supplied from the driving element DT. The light emitting device EL may be implemented with an organic light emitting diode including an organic light emitting layer, or may be implemented with an inorganic light emitting diode including an inorganic light emitting layer. An anode electrode of the light emitting device EL may be connected to a second node N2, and a cathode electrode thereof may be connected to an input terminal for a second source voltage EVSS.

The driving element DT may generate the driving current on the basis of a gate-source voltage thereof. A gate electrode of the driving element DT may be connected to a first node N1, a drain electrode thereof may be connected to an input terminal for a high level pixel voltage EVDD through a high level power line PWL, and a source electrode thereof may be connected to the second node N2.

The switch elements ST1 and ST2 may be turned on and may connect the gate electrode of the driving element DT to the data line 140, connect the source electrode of the driving element DT to the reference voltage line 150, and set the gate-source voltage of the driving element DT. The switch elements (for example, first and second switch elements) ST1 and ST2 may be turned on based on the same gate signal SCAN.

The first switch element ST1 may be connected between the data line 140 and the first node N1 and may be turned on based on the gate signal SCAN from the gate line 160. The first switch element ST1 may be turned on in programming for display driving and may also be turned on in sensing driving. When the first switch element ST1 is turned on, a sensing data voltage VSEN or a display data voltage VDIS may be applied to the first node N1. A gate electrode of the first switch element ST1 may be connected to the gate line 160, a source electrode thereof may be connected to the data line 140, and a drain electrode thereof may be connected to the first node N1.

The second switch element ST2 may be connected between the reference voltage line 150 and the second node N2 and may be turned on based on the gate signal SCAN from the gate line 160. The second switch element ST2 may be turned on in programming for display driving and may apply a first reference voltage Vref to the second node N2. In sensing driving, the second switch element ST2 may be turned on, may apply the first reference voltage Vref to the second node N2, and may transfer the driving current, generated by the driving element DT, to the reference voltage line 150. A gate electrode of the second switch element ST2 may be connected to the gate line 160, a drain electrode thereof may be connected to the second node N2, and a source electrode thereof may be connected to the reference voltage line 150.

The storage capacitor Cst may be connected between the first node N1 and the second node N2 and may store the gate-source voltage of the driving element DT.

Referring to FIG. 4, the driving & sensing circuit 251 may be connected to the pixel PXL through the data line 140 and the reference voltage line 150.

The driving & sensing circuit 251 may include a reference voltage output circuit VR, a digital-to-analog converter DAC, a first amplifier AMP1, a first capacitor C1, a second capacitor C2, a first switch SW1, a second switch SW2, a sampling switch SAM, and an analog-to-digital converter ADC.

The reference voltage output circuit VR may receive the first reference voltage Vref from an external power circuit 60 and may output the first reference voltage Vref. The reference voltage output circuit VR may be implemented with a voltage buffer.

The first switch SW1 may be connected between the reference voltage line 150 and the reference voltage output circuit VR. The first switch SW1 may be turned on in display driving and may be turned on in an initialization period of sensing driving, and moreover, may be turned off in a sensing period and a sampling period of sensing driving.

The digital-to-analog converter DAC may digital-analog convert correction image data in display driving to generate a display data voltage. The digital-to-analog converter DAC may generate a sensing data voltage Vdata having a certain level in sensing driving.

The first amplifier AMP1 may include a first non-inverting input terminal (+) connected to the digital-to-analog converter DAC, a first output terminal connected to the data line 140, and a first inverting input terminal (−).

The first capacitor C1 may be connected between the first inverting input terminal (−) of the first amplifier AMP1 and the reference voltage line 150. The first capacitor C1 may fix a voltage of the reference voltage line 150 to the first reference voltage Vref in sensing driving.

The second capacitor C2 may be connected between an output terminal of the first amplifier AMP1 and the reference voltage line 150. The second capacitor C2 may act as a feedback capacitor of a current integrator. A capacitance of the second capacitor C2 may be one-tenths to one-hundredths less than a parasitic capacitance which is in the reference voltage line 150.

The second switch SW2 may be connected between the first inverting input terminal (−) and the output terminal of the first amplifier AMP1. The second switch SW2 may act as a reset switch of the current integrator. The second switch SW2 may be turned on in the initialization period in display driving and sensing driving and may be turned off in the sensing period and the sampling period in sensing driving.

The second switch SW2 may be turned on, and thus, the first amplifier AMP1 may function as a voltage buffer in display driving and may buffer a display data voltage input through the first non-inverting input terminal (+) to output a buffered display data voltage to the data line 140.

When the second switch SW2 is turned on in the initialization period in sensing driving, the first amplifier AMP1 may function as a voltage buffer and may buffer the sensing data voltage Vdata input through the first non-inverting input terminal (+) to output a buffered sensing data voltage to the data line 140. Also, the second capacitor C2 may be simultaneously initialized.

When the second switch SW2 is turned off in the sensing period in sensing driving, the first amplifier AMP1 and the second capacitor C2 may function as a current integrator, and the driving current input through the reference voltage line 150 may be accumulated in the second capacitor C2. As the driving current is accumulated in the second capacitor C2, a voltage of the data line 140 may be lowered to an off voltage for turning off the driving element DT.

The analog-to-digital converter ADC may detect an off voltage of the driving element DT from the data line 140 and may analog-digital convert the off voltage to output digital sensing data.

The sampling switch SAM may be connected between the data line 140 and the analog-to-digital converter ADC. The sampling switch SAM may be turned on in only the sampling period in sensing driving and may maintain a turn-off state in the other period.

Figure 5:
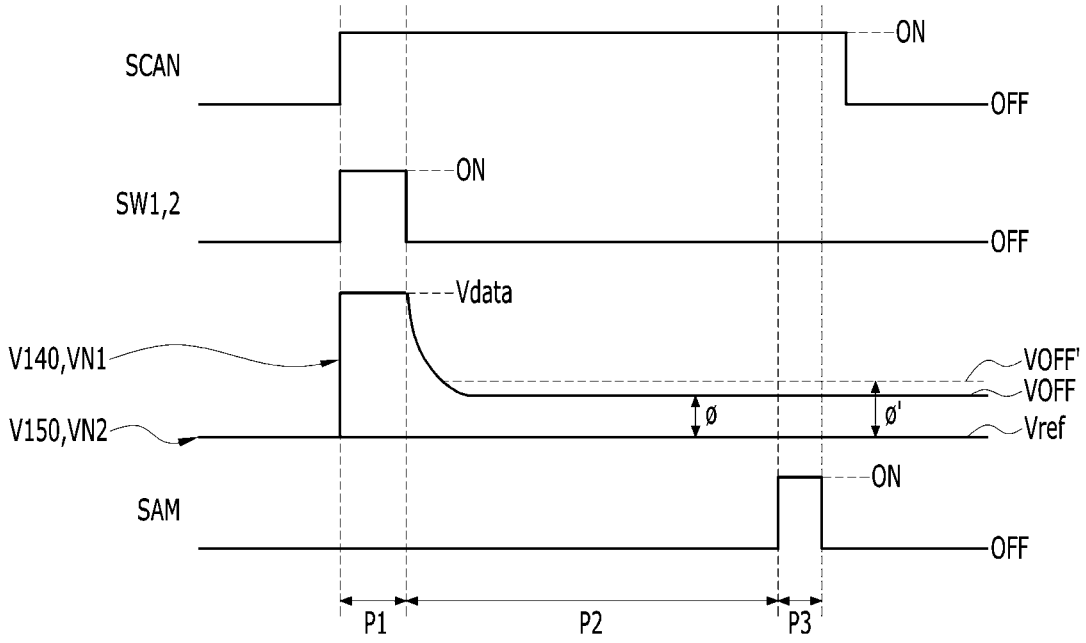
FIG. 5 is a waveform diagram when the pixel and the driving & sensing circuit of FIG. 4 perform a sensing operation.
Figure 6A:
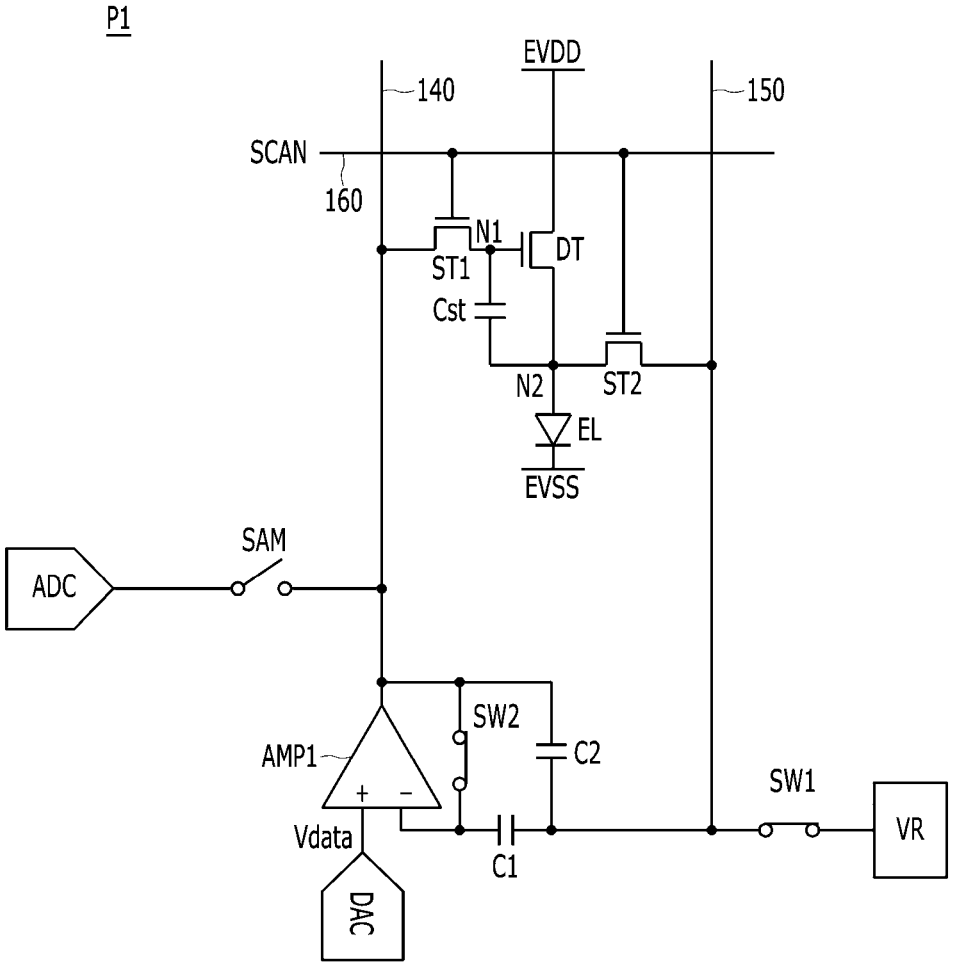
FIGS. 6A to 6C are diagrams illustrating operations of the pixel and the driving & sensing circuit of FIG. 4 in an initialization period, a sensing period, and a sampling period of FIG. 5.
Figure 6B:
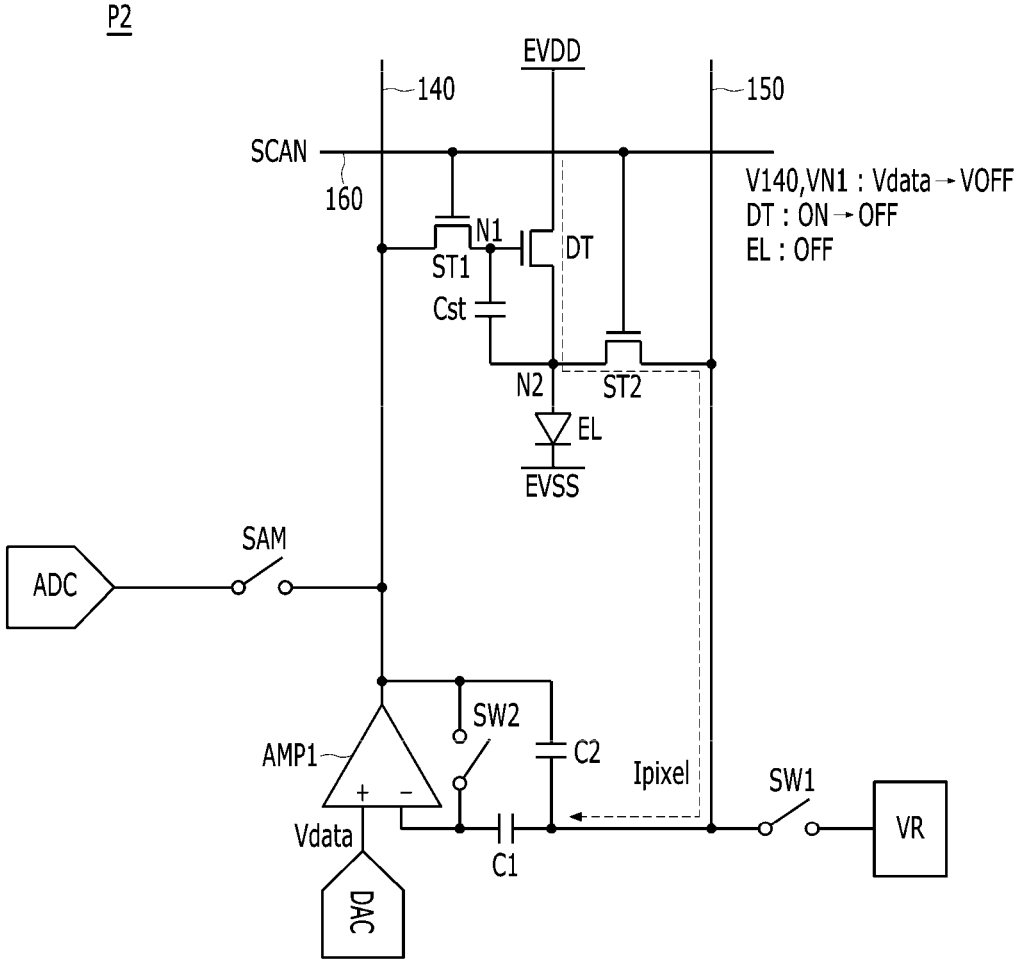
Figure 6C:
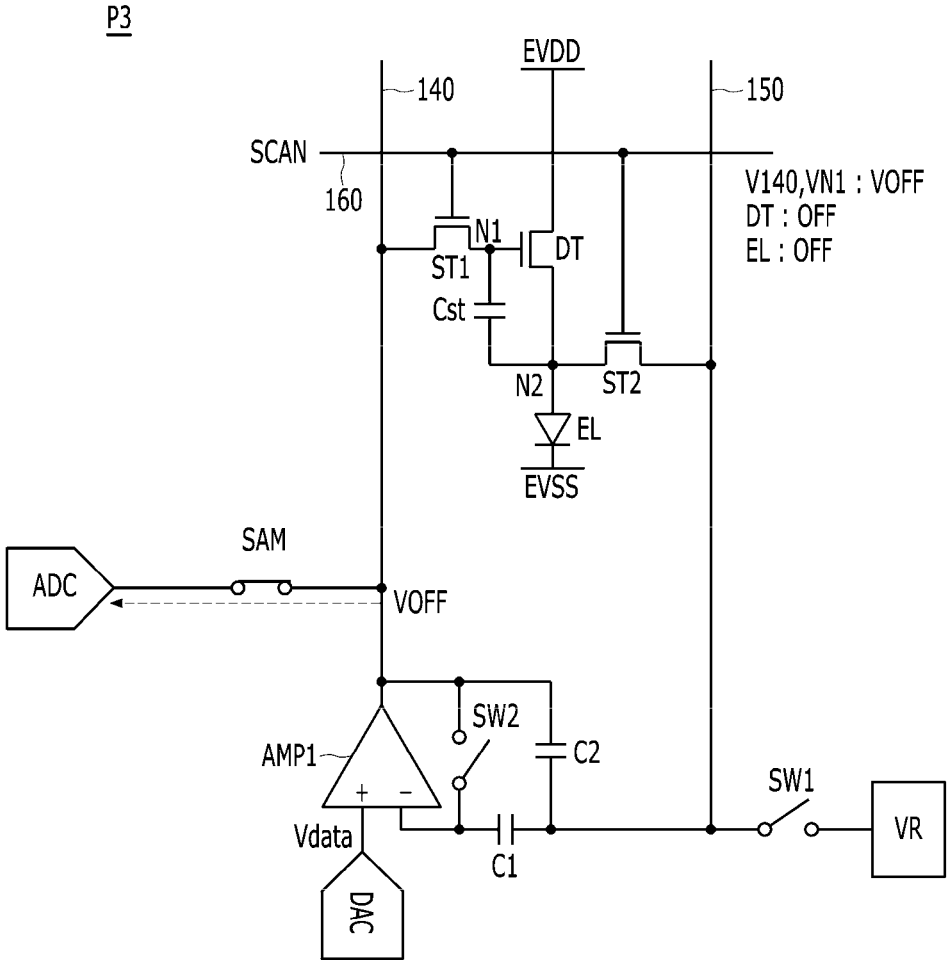

FIG. 5 is a waveform diagram when the pixel and the driving & sensing circuit of FIG. 4 perform a sensing operation. FIGS. 6A to 6C are diagrams illustrating operations of the pixel and the driving & sensing circuit of FIG. 4 in an initialization period, a sensing period, and a sampling period of FIG. 5.

Referring to FIG. 5, in sensing driving, a gate signal SCAN having an on level may be supplied to the gate line 160. When the first and second switch elements ST1 and ST2 are turned on in a scan-on period where the gate signal SCAN has an on level, a gate electrode of the driving element DT may be connected to the data line 140, and a source electrode of the driving element DT may be connected to the reference voltage line 150. The scan-on period for sensing driving may include an initialization period P1, a sensing period P2 succeeding the initialization period P1, and a sampling period P3 succeeding the sensing period P2.

Referring to FIGS. 5 and 6A, in the initialization period P1, first and second switches SW1 and SW2 may be turned on, and a sampling switch SAM may maintain an off state.

In the initialization period P1, a sensing data voltage Vdata may be supplied to a data line 140 and a gate electrode of a driving element DT, and a first reference voltage Vref may be supplied to a reference voltage line 150 and a source electrode of the driving element DT. At this time, a gate-source voltage "Vdata−Vref" of the driving element DT may be higher than a threshold voltage of the driving element DT, and thus, the driving element DT may enter a turn-on state.

Referring to FIGS. 5 and 6B, in the sensing period P2, the first and second switches SW1 and SW2 may be turned off, and the sampling switch SAM may maintain an off state.

In the sensing period P2, a driving current Ipixel proportional to the square of "(Vdata−Vref)−φ" may flow between a drain electrode and a source electrode of the driving element DT. Here, "φ" may be a threshold voltage of the driving element DT. The driving current Ipixel may be supplied to one electrode of the second capacitor C2 through the reference voltage line 150.

As the driving current Ipixel is accumulated in the second capacitor C2, a voltage V140 of the data line 140 and a gate voltage VN1 of the driving element DT may be reduced from the sensing data voltage Vdata to an off voltage VOFF. When the voltage V140 of the data line 140 and the gate voltage VN1 of the driving element DT are the off voltage VOFF, the driving element DT may be turned off, and the flow of the driving current Ipixel may stop.

In the sensing period P2, a voltage V150 of the reference voltage line 150 and a source voltage VN2 of the driving element DT may maintain the first reference voltage Vref, and thus, a sensing tack time may be independent of an adverse effect of a parasitic capacitance of the reference voltage line 150.

Referring to FIGS. 5 and 6C, in the sampling period P3, the first and second switches SW1 and SW2 may maintain a turn-off state, and the sampling switch SAM may be turned on.

In the sampling period P3, the analog-to-digital converter ADC may detect an off voltage VOFF from the data line 140. A difference between the off voltage VOFF and the first reference voltage Vref may be a threshold voltage φ of the driving element DT, and thus, the off voltage VOFF may be a criterion for determining the threshold voltage φ of the driving element DT.

A level of the off voltage may vary based on the degree of degradation of the pixel PXL. For example, as in FIG. 5, a level of the off voltage may be VOFF in a first pixel where the degree of degradation is relatively small and may be VOFF', which is higher than VOFF, in a second pixel where the degree of degradation is relatively large. In this case, a threshold voltage level of the first pixel may be φ, and a threshold voltage level of the second pixel may be φ'. Also, φ' may be greater than φ. Accordingly, when a level of the off voltage is detected, a threshold voltage level of a corresponding pixel may be determined.

Furthermore, in a scan-on period for sensing driving, the light emitting device EL may be in a non-emission state, and thus, the accuracy of detection of a threshold voltage may be enhanced.

Second Embodiment

Figure 7:
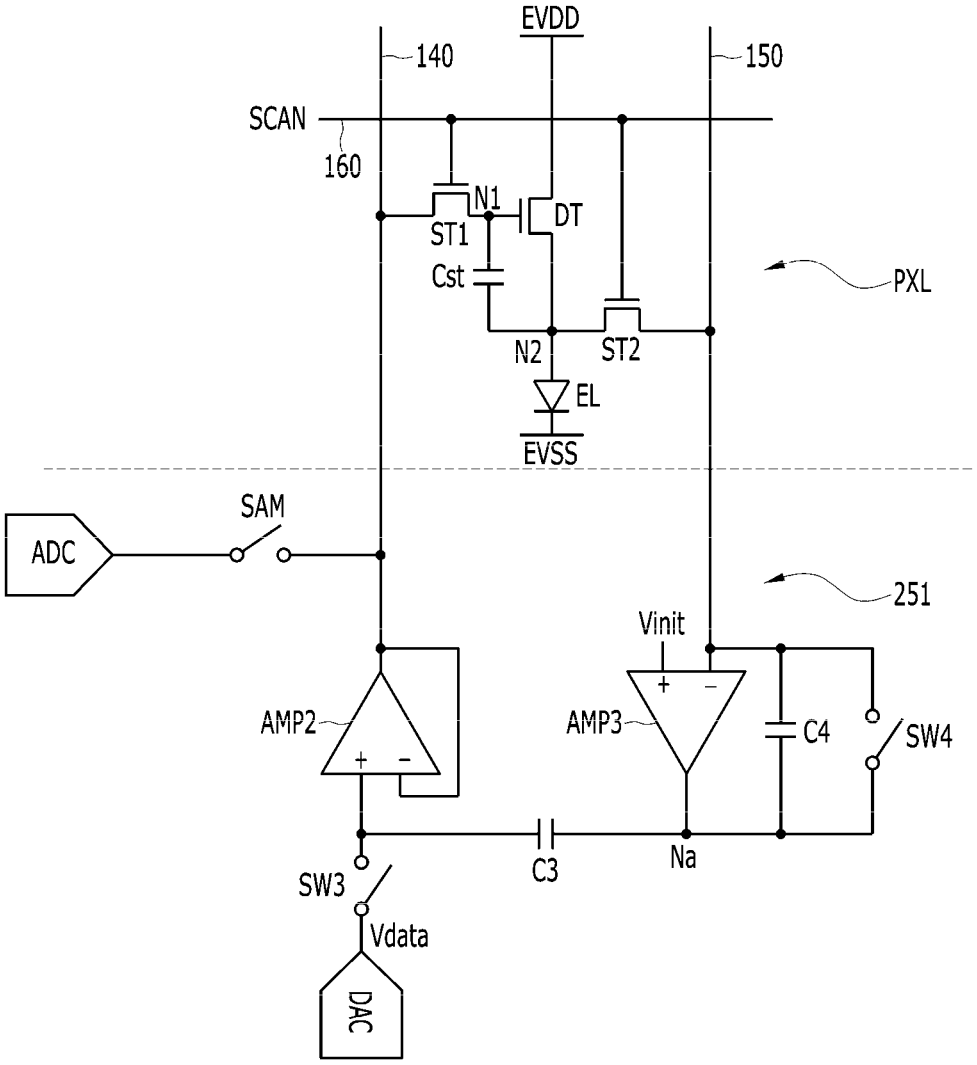
FIG. 7 is a diagram illustrating a second embodiment of a connection configuration between the pixel and the driving & sensing circuit included in FIG. 3.

FIG. 7 is a diagram illustrating a second embodiment of a connection configuration between the pixel and the driving & sensing circuit included in FIG. 3.

Referring to FIG. 7, a configuration of a pixel PXL may be substantially the same as the description of FIG. 4, and thus, its repeated description is omitted.

Referring to FIG. 7, a driving & sensing circuit 251 may be connected to the pixel PXL through a data line 140 and a reference voltage line 150.

The driving & sensing circuit 251 may include a digital-to-analog converter DAC, a second amplifier AMP2, a third amplifier AMP3, a third capacitor C3, a fourth capacitor C4, a third switch SW3, a fourth switch SW4, a sampling switch SAM, and an analog-to-digital converter ADC.

The digital-to-analog converter DAC may digital-analog convert correction image data in display driving to generate a display data voltage. The digital-to-analog converter DAC may generate a sensing data voltage Vdata having a certain level in sensing driving.

The second amplifier AMP2 may include a second non-inverting input terminal (+), a second output terminal connected to the data line 140, and a second inverting input terminal (−) connected to the second output terminal. The second amplifier AMP2 may function as a voltage buffer in display driving and sensing driving.

The third switch SW3 may be connected between the digital-to-analog converter DAC and the second non-inverting input terminal (+) of the second amplifier AMP2. The third switch SW3 may be turned on in display driving and may be turned on in an initialization period of sensing driving, and moreover, may be turned off in a sensing period and a sampling period of sensing driving.

The third amplifier AMP3 may include a third non-inverting input terminal (+) through which a second reference voltage Vinit is input from the power circuit 60, a third inverting input terminal (−) connected to the reference voltage line 150, and a third output terminal connected to a first output node Na.

The fourth capacitor C4 and the fourth switch SW4 may be connected between the third inverting input terminal (−) and the third output terminal of the third amplifier AMP3. The fourth capacitor C4 may act as a feedback capacitor of a current integrator. A capacitance of the fourth capacitor C4 may be one-tenths to one-hundredths less than a parasitic capacitance which is in the reference voltage line 150. The fourth switch SW4 may act as a reset switch of the current integrator.

The fourth switch SW4 may be turned on in the initialization period in display driving and sensing driving and may be turned off in the sensing period and the sampling period in sensing driving. The fourth switch SW4 may be turned on, and thus, the third amplifier AMP3 may function as a voltage buffer in display driving, and thus, the reference voltage line 150 and the first output node Na may hold the second reference voltage Vinit.

When the fourth switch SW4 is turned on in the initialization period in sensing driving, the third amplifier AMP3 may function as a voltage buffer, and thus, the reference voltage line 150 and the first output node Na may be initialized to the second reference voltage Vinit.

When the fourth switch SW4 is turned off in the sensing period in sensing driving, the third amplifier AMP3 and the fourth capacitor C4 may function as a current integrator, and the driving current input through the reference voltage line 150 may be accumulated in the fourth capacitor C4. As the driving current is accumulated in the fourth capacitor C4, a voltage of the first output node Na may be lowered to the second reference voltage Vinit.

The third capacitor C3 may be connected between the second non-inverting input terminal (+) of the second amplifier AMP2 and the first output node Na. In the sensing period in sensing driving, the third capacitor C3 may transfer a voltage variation of the first output node Na based on the driving current to the data line 140 through the second amplifier AMP2. Based on coupling through the third capacitor C3, a voltage of the data line 140 may be lowered to an off voltage for turning off the driving element DT in the sensing period in sensing driving.

The analog-to-digital converter ADC may detect an off voltage of the driving element DT from the data line 140 and may analog-digital convert the off voltage to output digital sensing data.

The sampling switch SAM may be connected between the data line 140 and the analog-to-digital converter ADC. The sampling switch SAM may be turned on in only the sampling period in sensing driving and may maintain a turn-off state in the other period.

Figure 8:
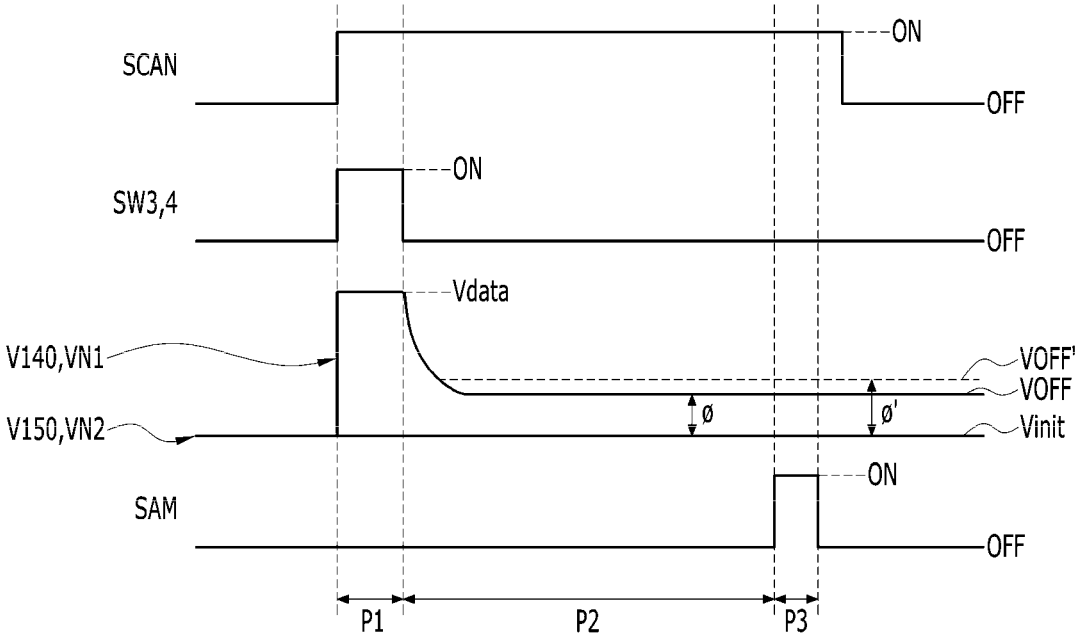
FIG. 8 is a waveform diagram when the pixel and the driving & sensing circuit of FIG. 7 perform a sensing operation.
Figure 9A:
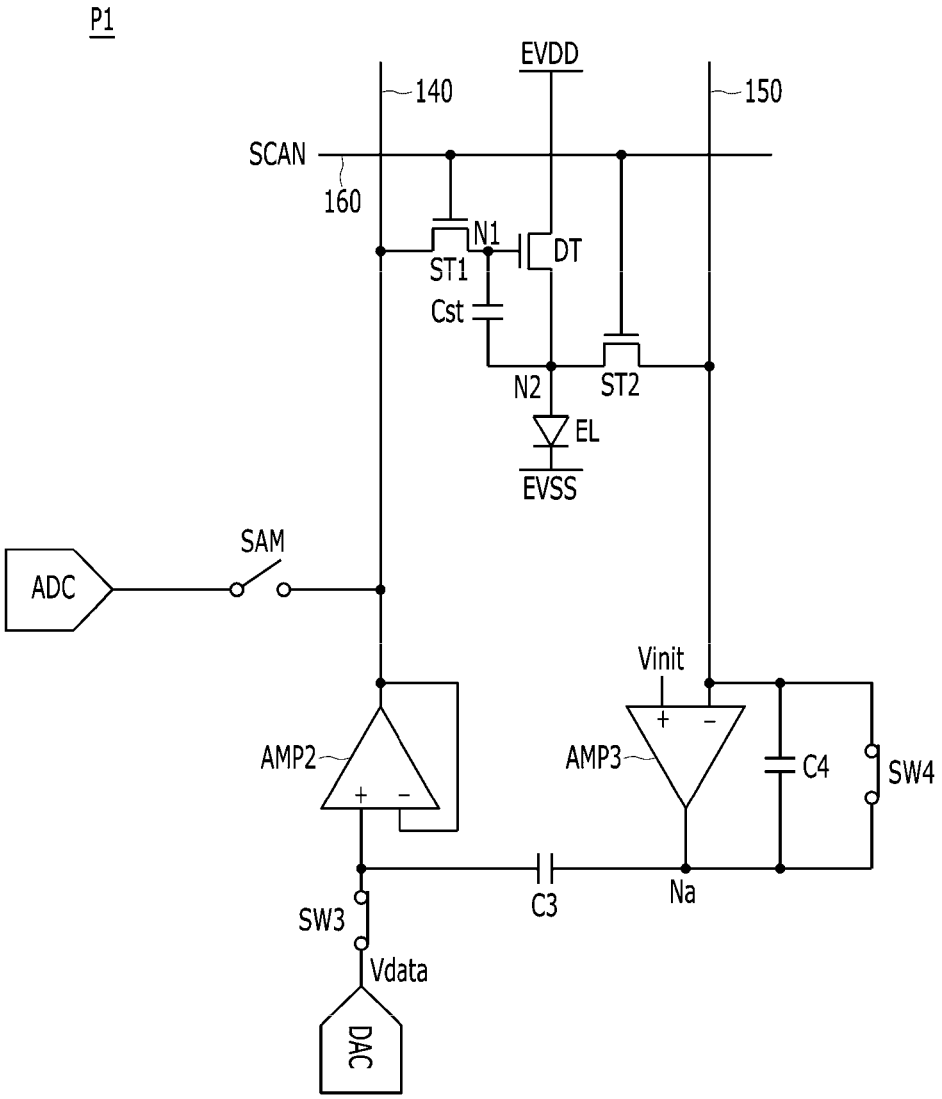
FIGS. 9A to 9C are diagrams illustrating operations of the pixel and the driving & sensing circuit of FIG. 7 in an initialization period, a sensing period, and a sampling period of FIG. 8.
Figure 9B:
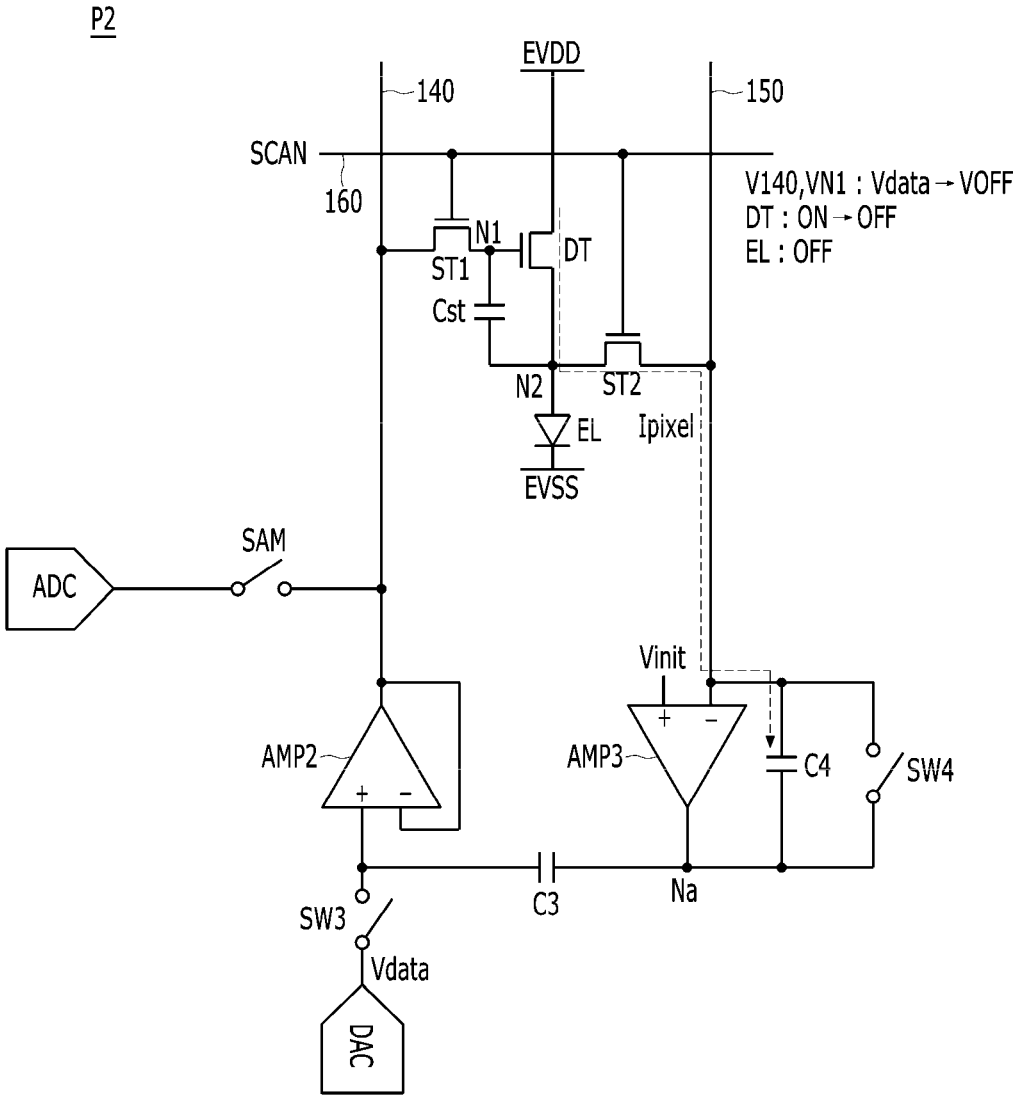
Figure 9C:
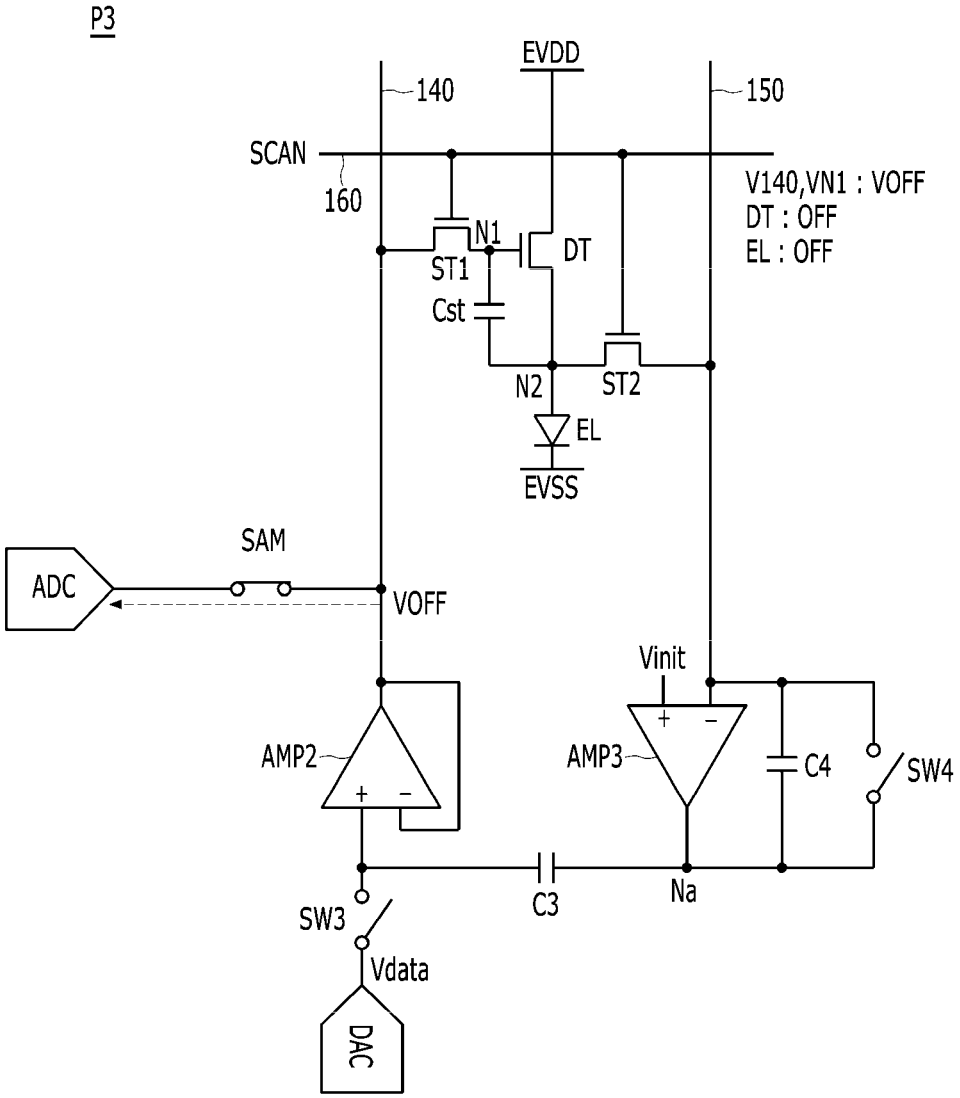

FIG. 8 is a waveform diagram when the pixel and the driving & sensing circuit of FIG. 7 perform a sensing operation. FIGS. 9A to 9C are diagrams illustrating operations of the pixel and the driving & sensing circuit of FIG. 7 in an initialization period, a sensing period, and a sampling period of FIG. 8.

Referring to FIG. 8, in sensing driving, a gate signal SCAN having an on level may be supplied to the gate line 160. When the first and second switch elements ST1 and ST2 are turned on in a scan-on period where the gate signal SCAN has an on level, a gate electrode of the driving element DT may be connected to the data line 140, and a source electrode of the driving element DT may be connected to the reference voltage line 150. The scan-on period for sensing driving may include an initialization period P1, a sensing period P2 succeeding the initialization period P1, and a sampling period P3 succeeding the sensing period P2.

Referring to FIGS. 8 and 9A, in the initialization period P1, third and fourth switches SW3 and SW4 may be turned on, and a sampling switch SAM may maintain an off state.

In the initialization period P1, a sensing data voltage Vdata may be supplied to a data line 140 and a gate electrode of a driving element DT, and a second reference voltage Vinit may be supplied to a reference voltage line 150 and a source electrode of the driving element DT. At this time, a gate-source voltage "Vdata-Vinit" of the driving element DT may be higher than a threshold voltage of the driving element DT, and thus, the driving element DT may enter a turn-on state. In the initialization period P1, a voltage of a first output node Na may be the second reference voltage Vinit.

Referring to FIGS. 8 and 9B, in the sensing period P2, the third and fourth switches SW3 and SW4 may be turned off, and the sampling switch SAM may maintain an off state.

In the sensing period P2, a driving current Ipixel proportional to the square of "(Vdata−Vinit)−φ" may flow between a drain electrode and a source electrode of the driving element DT. Here, "φ" may be a threshold voltage of the driving element DT. The driving current Ipixel may be supplied to one electrode of the fourth capacitor C4 through the reference voltage line 150.

As the driving current Ipixel is accumulated in the fourth capacitor C4, the voltage of the first output node Na may be lowered progressively from the second reference voltage Vinit. A voltage variation of the first output node Na may be transferred to the data line 140 through the third capacitor C3 and the second amplifier AMP2. A voltage V140 of the data line 140 may decrease by the voltage variation of the first output node Na. Therefore, the voltage V140 of the data line 140 and a gate voltage VN1 of the driving element DT may decrease from the sensing data voltage Vdata to an off voltage VOFF. When the voltage V140 of the data line 140 and the gate voltage VN1 of the driving element DT are the off voltage VOFF, the driving element DT may be turned off, and the flow of the driving current Ipixel may stop.

In the sensing period P2, a voltage V150 of the reference voltage line 150 and a source voltage VN2 of the driving element DT may maintain the second reference voltage Vinit, and thus, a sensing tack time may be independent of an adverse effect of a parasitic capacitance of the reference voltage line 150.

Referring to FIGS. 8 and 9C, in the sampling period P3, the first and second switches SW1 and SW2 may maintain a turn-off state, and the sampling switch SAM may be turned on.

In the sampling period P3, the analog-to-digital converter ADC may detect the off voltage VOFF from the data line 140. A difference between the off voltage VOFF and the second reference voltage Vinit may be a threshold voltage ci of the driving element DT, and thus, the off voltage VOFF may be a criterion for determining the threshold voltage ci of the driving element DT.

A level of the off voltage may vary based on the degree of degradation of the pixel PXL. For example, as in FIG. 8, a level of the off voltage may be VOFF in a first pixel where the degree of degradation is relatively small and may be VOFF', which is higher than VOFF, in a second pixel where the degree of degradation is relatively large. In this case, a threshold voltage level of the first pixel may be φ, and a threshold voltage level of the second pixel may be φ'. Also, φ' may be greater than φ. Accordingly, when a level of the off voltage is detected, a threshold voltage level of a corresponding pixel may be determined.

Furthermore, in a scan-on period for sensing driving, the light emitting device EL may be in a non-emission state, and thus, the accuracy of detection of a threshold voltage may be enhanced.

Third Embodiment

Figure 10:
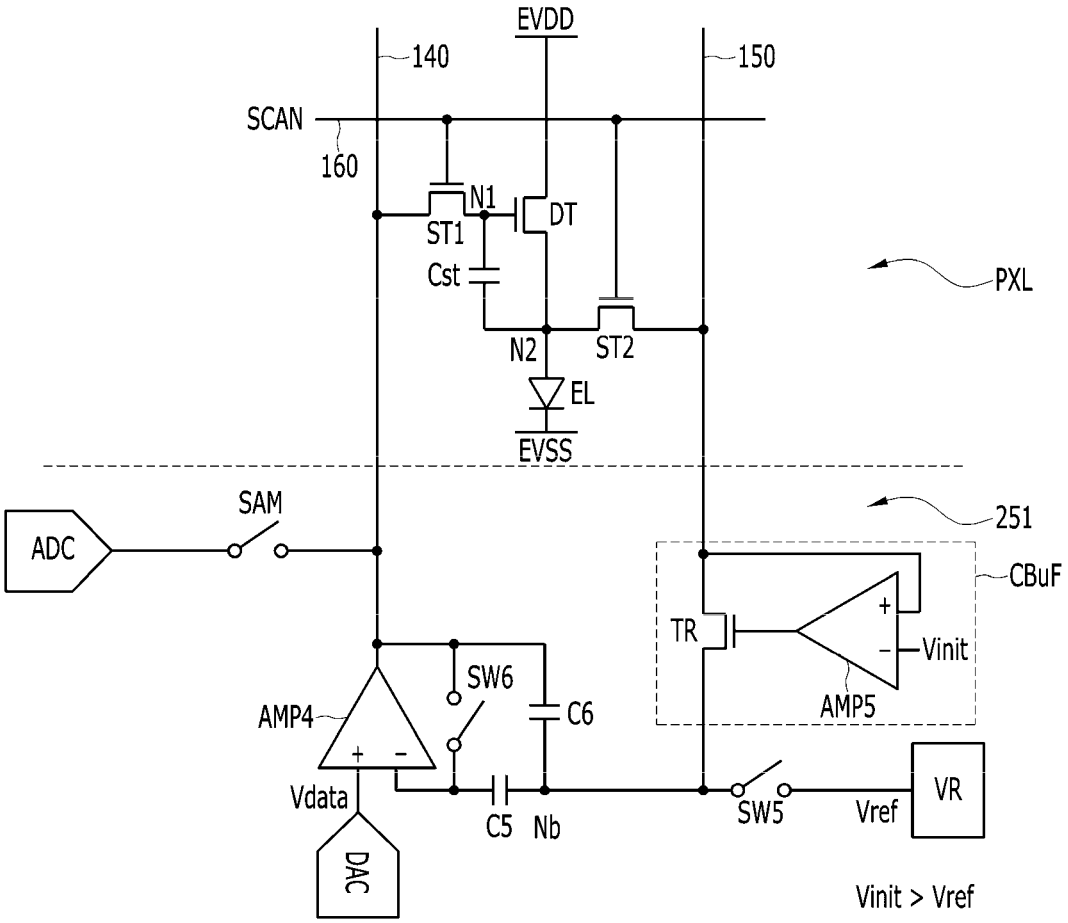
FIG. 10 is a diagram illustrating a third embodiment of a connection configuration between the pixel and the driving & sensing circuit included in FIG. 3.

FIG. 10 is a diagram illustrating a third embodiment of a connection configuration between the pixel and the driving & sensing circuit included in FIG. 3.

Referring to FIG. 10, a configuration of a pixel PXL may be substantially the same as the description of FIG. 4, and thus, its repeated description is omitted.

Referring to FIG. 10, a driving & sensing circuit 251 may be connected to the pixel PXL through a data line 140 and a reference voltage line 150.

Comparing with the driving & sensing circuit 251 of FIG. 4, there may be a difference in that the driving & sensing circuit 251 of FIG. 10 further includes a current buffer CBuF connected between the reference voltage line 150 and a second output node Nb. The current buffer CBuF may separate a load to prevent noise included in a driving current from being amplified by a current integrator, so that the reference voltage line 150 is not directly connected to a feedback capacitor C6 of the current integrator. The current buffer CBuF may remove a noise component included in the driving current and may supply a noise-removed driving current to the feedback capacitor C6 of the current integrator.

To provide a detailed description, the driving & sensing circuit 251 may include a reference voltage output circuit VR, a digital-to-analog converter DAC, a fourth amplifier AMP4, a fifth capacitor C5, a sixth capacitor C6, a fifth switch SW5, a sixth switch SW6, a sampling switch SAM, an analog-to-digital converter ADC, and a current buffer CBuF.

The reference voltage output circuit VR may receive the first reference voltage Vref from an external power circuit 60 and may output the first reference voltage Vref. The reference voltage output circuit VR may be implemented with a voltage buffer.

The fifth switch SW5 may be connected between a second output node Nb and the reference voltage output circuit VR. The fifth switch SW5 may be turned on in display driving and may be turned on in an initialization period of sensing driving, and moreover, may be turned off in a sensing period and a sampling period of sensing driving.

The digital-to-analog converter DAC may digital-analog convert correction image data in display driving to generate a display data voltage. The digital-to-analog converter DAC may generate a sensing data voltage Vdata having a certain level in sensing driving.

The fourth amplifier AMP4 may include a fourth non-inverting input terminal (+) connected to the digital-to-analog converter DAC, a fourth output terminal connected to the data line 140, and a fourth inverting input terminal (−).

The fifth capacitor C5 may be connected between the fourth inverting input terminal (−) of the fourth amplifier AMP4 and the second output node Nb. The fifth capacitor C5 may fix a voltage of the second output node Nb to the first reference voltage Vref in sensing driving.

The sixth capacitor C6 may be connected between the fourth output terminal of the fourth amplifier AMP4 and the second output node Nb. The sixth capacitor C6 may act as a feedback capacitor of a current integrator. A capacitance of the sixth capacitor C6 may be one-tenths to one-hundredths less than a parasitic capacitance which is in the reference voltage line 150.

The sixth switch SW6 may be connected between the fourth inverting input terminal (−) and the fourth output terminal of the fourth amplifier AMP4. The sixth switch SW6 may act as a reset switch of the current integrator. The sixth switch SW6 may be turned on in the initialization period in display driving and sensing driving and may be turned off in the sensing period and the sampling period in sensing driving.

The sixth switch SW6 may be turned on, and thus, the fourth amplifier AMP4 may function as a voltage buffer in display driving and may buffer a display data voltage input through the fourth non-inverting input terminal (+) to output a buffered display data voltage to the data line 140.

When the sixth switch SW6 is turned on in the initialization period in sensing driving, the fourth amplifier AMP4 may function as a voltage buffer and may buffer the sensing data voltage Vdata input through the fourth non-inverting input terminal (+) to output a buffered sensing data voltage to the data line 140. Also, the sixth capacitor C6 may be simultaneously initialized.

When the sixth switch SW6 is turned off in the sensing period in sensing driving, the fourth amplifier AMP4 and the sixth capacitor C6 may function as a current integrator, and the driving current input through the second output node Nb may be accumulated in the sixth capacitor C6. As the driving current is accumulated in the sixth capacitor C6, a voltage of the data line 140 may be lowered to an off voltage for turning off the driving element DT.

The analog-to-digital converter ADC may detect an off voltage of the driving element DT from the data line 140 and may analog-digital convert the off voltage to output digital sensing data.

The sampling switch SAM may be connected between the data line 140 and the analog-to-digital converter ADC. The sampling switch SAM may be turned on in only the sampling period in sensing driving and may maintain a turn-off state in the other period.

The current buffer CBuF may be connected between the reference voltage line 150 and the second output node Nb. The current buffer CBuF may include a buffer transistor TR connected between the reference voltage line 150 and the second output node Nb and a buffer amplifier AMP5. The buffer amplifier AMP5 may include a fifth non-inverting input terminal (+) connected to the reference voltage line 150, a fifth inverting input terminal (−) through which a second reference voltage Vinit is input, and a fifth output terminal connected to a gate electrode of the buffer transistor TR.

The second reference voltage Vinit may be higher than the first reference voltage Vref so that the current buffer CBuF continuously maintains a turn-on state in a scan-on period where sensing driving is performed.

Figure 11:
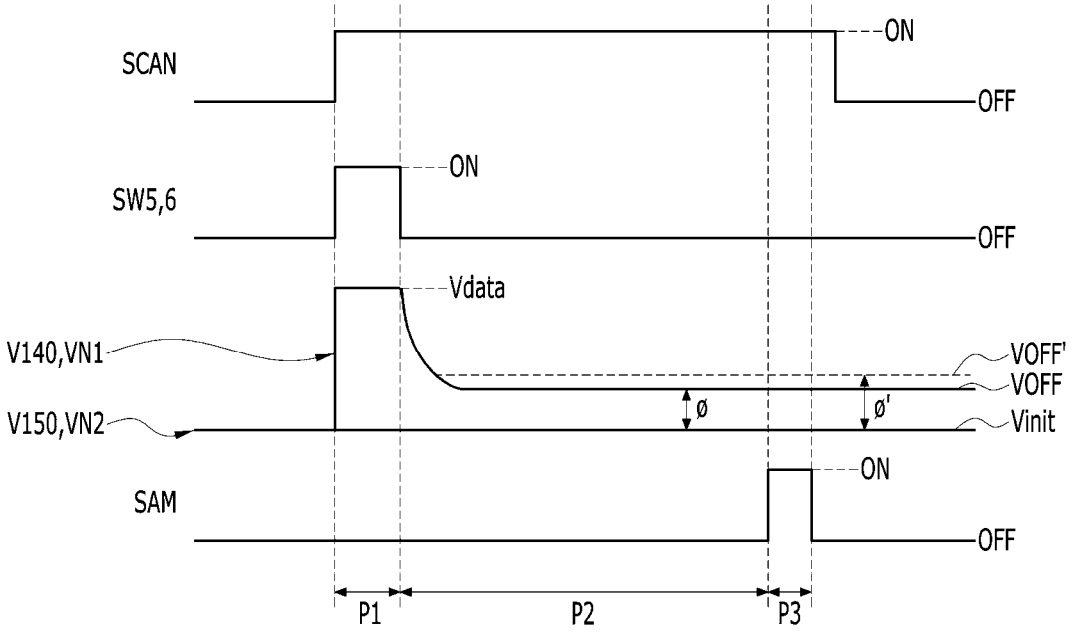
FIG. 11 is a waveform diagram when the pixel and the driving & sensing circuit of FIG. 10 perform a sensing operation.
Figure 12A:
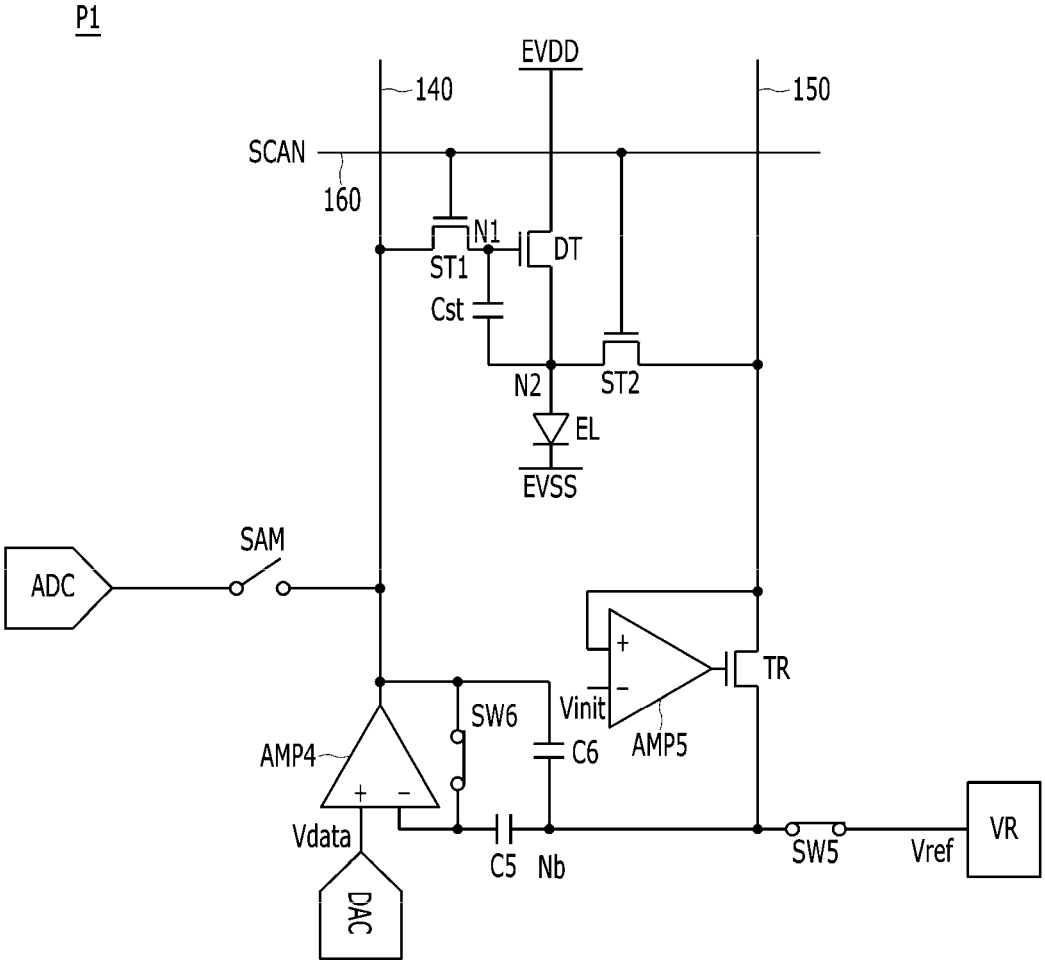
FIGS. 12A to 12C are diagrams illustrating operations of the pixel and the driving & sensing circuit of FIG. 10 in an initialization period, a sensing period, and a sampling period of FIG. 11.
Figure 12B:
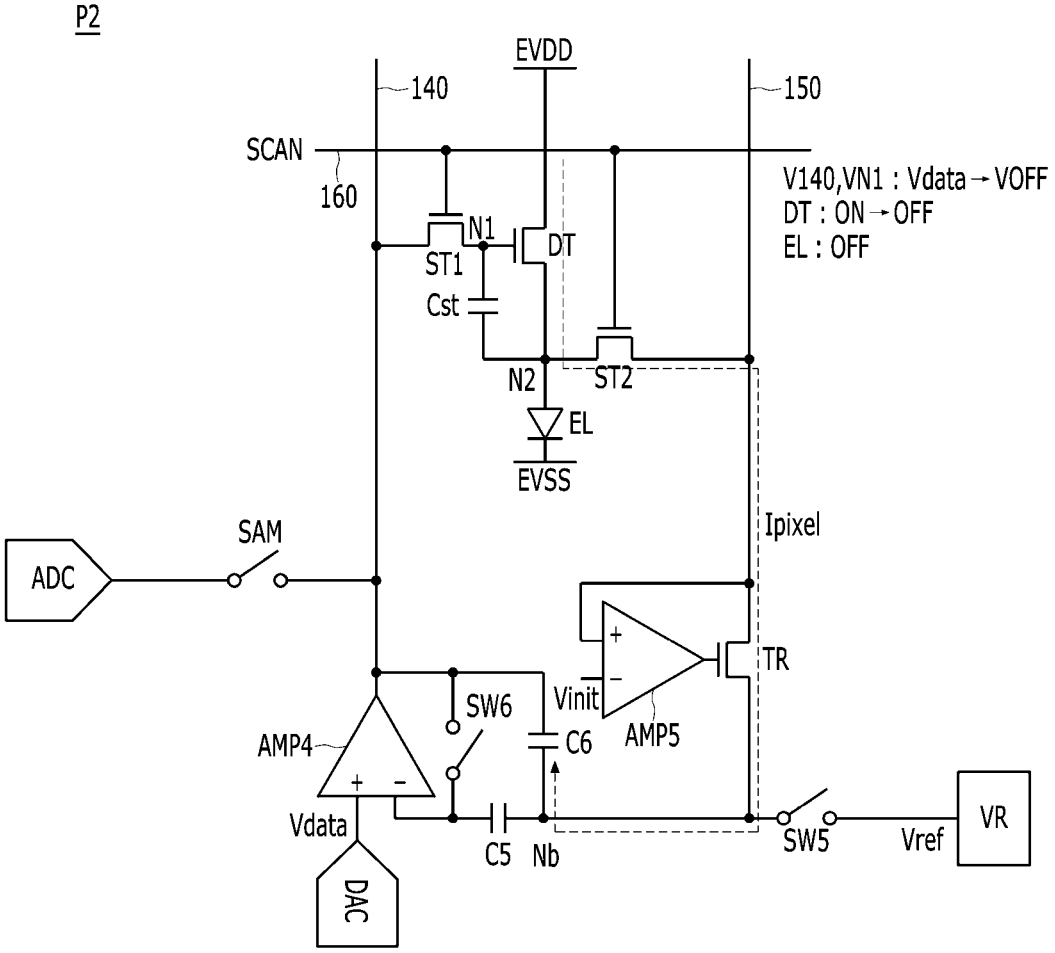
Figure 12C:
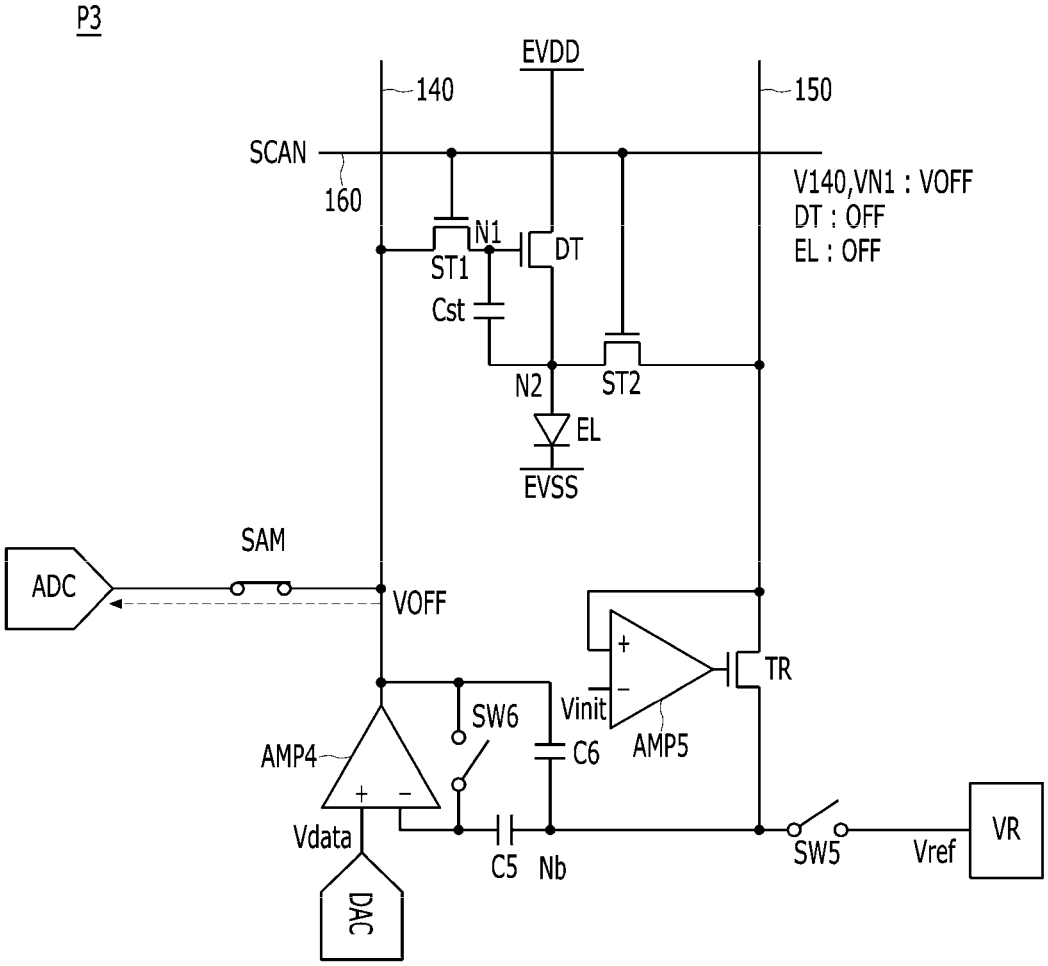

FIG. 11 is a waveform diagram when the pixel and the driving & sensing circuit of FIG. 10 perform a sensing operation. FIGS. 12A to 12C are diagrams illustrating operations of the pixel and the driving & sensing circuit of FIG. 10 in an initialization period, a sensing period, and a sampling period of FIG. 11.

Referring to FIG. 11, in sensing driving, a gate signal SCAN having an on level may be supplied to the gate line 160. When the first and second switch elements ST1 and ST2 are turned on in a scan-on period where the gate signal SCAN has an on level, a gate electrode of the driving element DT may be connected to the data line 140, and a source electrode of the driving element DT may be connected to the reference voltage line 150. The scan-on period for sensing driving may include an initialization period P1, a sensing period P2 succeeding the initialization period P1, and a sampling period P3 succeeding the sensing period P2.

Referring to FIGS. 11 and 12A, in the initialization period P1, fifth and sixth switches SW5 and SW6 may be turned on, and a sampling switch SAM may maintain an off state.

In the initialization period P1, a sensing data voltage Vdata may be supplied to a data line 140 and a gate electrode of a driving element DT, and a second reference voltage Vinit may be supplied to a reference voltage line 150 and a source electrode of the driving element DT. At this time, a gate-source voltage "Vdata-Vinit" of the driving element DT may be higher than a threshold voltage of the driving element DT, and thus, the driving element DT may enter a turn-on state. In the initialization period P1, a voltage of a second output node Nb may be the first reference voltage Vref.

Referring to FIGS. 11 and 12B, in the sensing period P2, the fifth and sixth switches SW5 and SW6 may be turned off, and the sampling switch SAM may maintain an off state.

In the sensing period P2, a driving current Ipixel proportional to the square of "(Vdata−Vinit)−φ" may flow between a drain electrode and a source electrode of the driving element DT. Here, "φ" may be a threshold voltage of the driving element DT. The driving current Ipixel may be supplied to one electrode of the sixth capacitor C6 through the reference voltage line 150 and the current buffer CBuF.

As the driving current Ipixel is accumulated in the sixth capacitor C6, a voltage V140 of the data line 140 and a gate voltage VN1 of the driving element DT may decrease from the sensing data voltage Vdata to an off voltage VOFF. When the voltage V140 of the data line 140 and the gate voltage VN1 of the driving element DT are the off voltage VOFF, the driving element DT may be turned off, and the flow of the driving current Ipixel may stop.

In the sensing period P2, a voltage V150 of the reference voltage line 150 and a source voltage VN2 of the driving element DT may maintain the second reference voltage Vinit, and thus, a sensing tack time may be independent of an adverse effect of a parasitic capacitance of the reference voltage line 150.

Referring to FIGS. 11 and 12C, in the sampling period P3, the fifth and sixth switches SW5 and SW6 may maintain a turn-off state, and the sampling switch SAM may be turned on.

In the sampling period P3, the analog-to-digital converter ADC may detect the off voltage VOFF from the data line 140. A difference between the off voltage VOFF and the second reference voltage Vinit may be a threshold voltage φ of the driving element DT, and thus, the off voltage VOFF may be a criterion for determining the threshold voltage φ of the driving element DT.

A level of the off voltage may vary based on the degree of degradation of the pixel PXL. For example, as in FIG. 11, a level of the off voltage may be VOFF in a first pixel where the degree of degradation is relatively small and may be VOFF', which is higher than VOFF, in a second pixel where the degree of degradation is relatively large. In this case, a threshold voltage level of the first pixel may be φ, and a threshold voltage level of the second pixel may be φ'. Also, φ' may be greater than φ. Accordingly, when a level of the off voltage is detected, a threshold voltage level of a corresponding pixel may be determined.

Furthermore, in a scan-on period for sensing driving, the light emitting device EL may be in a non-emission state, and thus, the accuracy of detection of a threshold voltage may be enhanced.

According to the embodiments of the present disclosure, a threshold voltage of a driving element may be quickly detected in a state where a parasitic capacitance influence of a reference voltage line is excluded, on the basis of a feedback loop configuration based on a current integrator. In the embodiments of the present disclosure, the current integrator may charge a feedback capacitor having a capacitance which is far less than the parasitic capacitance of the reference voltage line, and thus, a sensing tack time may be largely reduced. When the sensing tack time is reduced, real-time sensing and compensation may be performed and an update period of a compensation value may be short, and thus, the threshold voltage compensation performance of the driving element may be largely enhanced.

The effects according to the present disclosure are not limited to the above examples, and other various effects may be included in the specification.

It will be apparent to those skilled in the art that various modifications and variations can be made in the present disclosure without departing from the technical idea or scope of the disclosure. Thus, it is intended that the present disclosure cover the modifications and variations of this disclosure provided they come within the scope of the appended claims and their equivalents.

What is claimed is:

1. An electroluminescence display apparatus, comprising:

a pixel including a driving element generating a driving current;

a data line connected to the pixel to transfer a data voltage needed for generating the driving current;

a reference voltage line connected to the pixel to transfer a first reference voltage and/or a second reference voltage needed for generating the driving current; and a driving & sensing circuit configured to perform an integral on the driving current input through the reference voltage line, output an integral result to the data line, decrease a voltage of the data line from the data voltage to an off voltage for turning off the driving element, and detect the off voltage of the driving element from the data line.

2. The electroluminescence display apparatus of claim 1, wherein the driving & sensing circuit comprises:

a reference voltage output circuit configured to output the first reference voltage;

a fifth switch connected between a second output node and the reference voltage output circuit;

a digital-to-analog converter configured to generate the data voltage;

a fourth amplifier including a fourth non-inverting input terminal connected to the digital-to-analog converter, a fourth output terminal connected to the data line, and a fourth inverting input terminal;

a fifth capacitor connected between the fourth inverting input terminal and the second output node;

a sixth capacitor connected between the fourth output terminal and the second output node;

a sixth switch connected between the fourth inverting input terminal and the fourth output terminal;

a current buffer connected between the reference voltage line and the second output node;

an analog-to-digital converter configured to detect the off voltage of the driving element from the data line; and a sampling switch connected between the data line and the analog-to-digital converter.

3. The electroluminescence display apparatus of claim 2, wherein the current buffer comprises:

a buffer transistor connected between the reference voltage line and the second output node; and a buffer amplifier including a fifth non-inverting input terminal connected to the reference voltage line, a fifth inverting input terminal through which the second reference voltage is input, and a fifth output terminal connected to a gate electrode of the buffer transistor.

4. The electroluminescence display apparatus of claim 3, wherein, in a scan-on period, a gate electrode of the driving element is connected to the data line and a source electrode of the driving element is connected to the reference voltage line, the scan-on period comprises an initialization period, a sensing period succeeding the initialization period, and a sampling period succeeding the sensing period, in the initialization period, the fifth switch and the sixth switch are turned on and the sampling switch is turned off, in the sensing period, the fifth switch, the sixth switch, and the sampling switch are turned off, and in the sampling period, the fifth switch and the sixth switch are turned off and the sampling switch is turned on.

5. The electroluminescence display apparatus of claim 4, wherein the second reference voltage is higher than the first reference voltage, and the buffer transistor maintains a turn-on state in the scan-on period.

6. The electroluminescence display apparatus of claim 1, wherein the driving & sensing circuit comprises:

a reference voltage output circuit configured to output the first reference voltage;

a first switch connected between the reference voltage line and the reference voltage output circuit;

a digital-to-analog converter configured to generate the data voltage;

a first amplifier including a first non-inverting input terminal connected to the digital-to-analog converter, a first output terminal connected to the data line, and a first inverting input terminal;

a first capacitor connected between the first inverting input terminal and the reference voltage line;

a second capacitor connected between the first output terminal and the reference voltage line;

a second switch connected between the first inverting input terminal and the first output terminal;

an analog-to-digital converter configured to detect the off voltage of the driving element from the data line; and a sampling switch connected between the data line and the analog-to-digital converter.

7. The electroluminescence display apparatus of claim 6, wherein, in a scan-on period, a gate electrode of the driving element is connected to the data line and a source electrode of the driving element is connected to the reference voltage line, the scan-on period comprises an initialization period, a sensing period succeeding the initialization period, and a sampling period succeeding the sensing period, in the initialization period, the first switch and the second switch are turned on and the sampling switch is turned off, in the sensing period, the first switch, the second switch, and the sampling switch are turned off, and in the sampling period, the first switch and the second switch are turned off and the sampling switch is turned on.

8. The electroluminescence display apparatus of claim 1, wherein the driving & sensing circuit comprises:

a digital-to-analog converter configured to generate the data voltage;

a second amplifier including a second non-inverting input terminal, a second output terminal connected to the data line, and a second inverting input terminal connected to the second output terminal;

a third switch connected between the digital-to-analog converter and the second non-inverting input terminal;

a third capacitor connected between the second non-inverting input terminal and a first output node;

a third amplifier including a third non-inverting input terminal through which the second reference voltage is input, a third inverting input terminal connected to the reference voltage line, and a third output terminal connected to the first output node;

a fourth capacitor and a fourth switch connected in parallel between the third inverting input terminal and the third output terminal;

an analog-to-digital converter configured to detect the off voltage of the driving element from the data line; and a sampling switch connected between the data line and the analog-to-digital converter.

9. The electroluminescence display apparatus of claim 8, wherein, in a scan-on period, a gate electrode of the driving element is connected to the data line and a source electrode of the driving element is connected to the reference voltage line, the scan-on period comprises an initialization period, a sensing period succeeding the initialization period, and a sampling period succeeding the sensing period, in the initialization period, the third switch and the fourth switch are turned on and the sampling switch is turned off, in the sensing period, the third switch, the fourth switch, and the sampling switch are turned off, and in the sampling period, the third switch and the fourth switch are turned off and the sampling switch is turned on.

10. The electroluminescence display apparatus of claim 1, wherein the driving & sensing circuit configures a feedback loop between the data line and the reference voltage line.

11. A driving method of an electroluminescence display apparatus including a pixel including a driving element generating a driving current, the driving method comprising:

supplying a data voltage, needed for generating the driving current, to a data line connected to the pixel;

supplying a first reference voltage and/or a second reference voltage, needed for generating the driving current, to a reference voltage line connected to the pixel;

performing an integral on the driving current input through the reference voltage line, outputting an integral result to the data line, decreasing a voltage of the data line from the data voltage to an off voltage for turning off the driving element; and detecting the off voltage of the driving element from the data line.

* * * * *